US005656194A

United States Patent [19]

Zimmerman

[11] Patent Number: 5,656,194

[45] Date of Patent: Aug. 12, 1997

[54] ASSEMBLY JIG FOR PREFABRICATED CONCRETE WALLS

[75] Inventor: Melvin M. Zimmerman, Blue Ball, Pa.

[73] Assignee: Superior Walls of America, Ltd., Lititz, Pa.

[21] Appl. No.: 490,296

[22] Filed: Jun. 14, 1995

[51] Int. Cl.[6] ..... B28B 23/02

[52] U.S. Cl. ..... 249/160; 249/170; 249/171; 249/172

[58] Field of Search ..... 249/170, 160, 249/171, 172

[56] References Cited

U.S. PATENT DOCUMENTS

| | | | |
|---|---|---|---|
| 799,871 | 9/1905 | Savard | 249/172 |
| 1,006,053 | 10/1911 | Bolles | 249/172 |
| 3,132,403 | 5/1964 | Richards | 249/170 |
| 4,131,405 | 12/1978 | Moore | 249/170 |
| 4,570,398 | 2/1986 | Zimmerman | 52/169.11 |
| 4,605,529 | 8/1986 | Zimmerman | 264/263 |
| 4,751,803 | 6/1988 | Zimmerman | 52/414 |
| 4,934,121 | 6/1990 | Zimmerman | 52/583 |
| 5,055,252 | 10/1991 | Zimmerman | 264/263 |
| 5,524,861 | 6/1996 | Solomon | 249/170 |

FOREIGN PATENT DOCUMENTS

| | | | |
|---|---|---|---|
| 1186491 | 10/1985 | U.S.S.R. | 249/171 |

*Primary Examiner*—Thomas R. Weber
*Attorney, Agent, or Firm*—Martin Fruitman

[57] ABSTRACT

The apparatus is an assembly jig for constructing prefabricated concrete wall sections. Two parallel elongated "L" cross section members, each with an outer vertical wall, are connected to a base structure with pivots, and several separated sections of inner vertical walls are attached by pivots at the edge of the base of each "L" to form parallel channel molds with spaces in the inner walls to receive prefabricated concrete studs. The wall is constructed by placing concrete studs and insulation sheets between the channels, and pouring concrete into the channel molds and over the studs and insulation sheets. The "L" members are pivoted down to release the hardened concrete beam which has been formed within each mold and thereby facilitate removal of the finished wall section from the assembly jig.

7 Claims, 5 Drawing Sheets

ASSEMBLY JIG FOR PREFABRICATED CONCRETE WALLS

BACKGROUND OF THE INVENTION

This invention deals generally with building construction and more specifically with the construction of concrete prefabricated walls.

The traditional methods of constructing building basements are well established. For commercial structures and for high volume residential developments with identical dimensions for each building, poured concrete is used. This involves the construction of forms, either wood or metal, in the exact shape of the vertical basement walls, and then pouring concrete into the forms. After the concrete hardens, the forms are removed and construction continues on the rest of the building.

The cost of forms limits this method to structures where the height requires the strength of reinforced concrete or where the reuse of forms for many identical structures in the same general area permits sharing of the costs of form construction by many buildings.

The more common basement construction technique for individual residential houses is the straight forward construction of the vertical walls by laying many courses of cinder block, one on top of the other. This method is the traditional one used for isolated building sites and small developments, and it is both time consuming and labor intensive. It requires each cinder block to be individually placed and surrounded with mortar. One need only watch a traditional house being built to realize that the cinder block basement may take over a week to construct on a typical site, while the framing and exterior walls go up in just a day or so. Above ground walls of wood and sheathing have been prefabricated for over forty years, but prefabrication of concrete walls has only started very recently.

U.S. Pat. No. 4,605,529, issued Aug. 12, 1986 to Melvin M. Zimmerman, the present inventor, discloses a prefabricated concrete wall structure and the method and assembly jig for the wall's construction. The method disclosed permits construction of a wall which is no longer linked to the amount of manpower available at the construction site, because the labor at the construction site involves only installation of the previously manufactured wall. Moreover, the cost of the wall is relatively unrelated to the size of the wall.

However, the cost of such a prefabricated wall is greatly influenced by the ease of its off-site manufacture, and to facilitate construction the wall is constructed within a horizontal assembly jig, so that conventional concrete delivery trucks can be used as a source of material.

The assembly jig of the prior art is essentially a set of channel members oriented in a horizontal plane. The channels are arranged in parallel, about eight feet apart, and the channels include precut notches on their innermost walls. These notches are used to support previously manufactured concrete studs which are set in the horizontal plane perpendicular to the parallel channels. A typical spacing for the notches is two feet center to center.

The channel members and frame sides joining the ends of the channel members are constructed so that the peripheral edges of the grid formed by the studs and the channels, that is, the edges forming an outside rectangle, are higher than all the other members by approximately four inches to form a frame around the entire structure. The parallel channel members which form the support for the concrete studs include cavities of considerable volume which are eventually filled with concrete to encase the ends of the concrete studs which are set into the notches in the channels with the ends of the studs extending into the cavities.

Before concrete is poured into the assembly jig, sheet insulation is laid over the concrete studs and impaled upon fasteners cast into and protruding from the concrete studs, and wire reinforcing mesh is laid atop the sheet insulation, but the sheet insulation is sized so that it does not cover the cavities of the channel members.

The wall is then completed by pouring concrete into the jig so that it covers the insulation, the fasteners protruding through the insulation, and the wire mesh, and fills the cavities in the channel members. The concrete is poured to the height of the top of the outer frame members, and once hardened, not only forms an integral exterior surface, but also bonds together the studs, the insulation, and the top and bottom support beams which are formed in the channel members.

The prior art describes the final step of manufacture of the wall as lifting the hardened concrete wall from the assembly jig by jacking one edge of the wall out of the assembly jig, and then attaching lifting aids, such as eyebolts, to holes cast in the upper or lower concrete beams.

However, the task of removing the finished wall from the assembly jig disclosed in the prior art is much more difficult than one might suppose. There is a significant tendency for the wall to adhere to the jig and lock up within it. For example, concrete may leak through the edges of the notches cut in the channel members to support the studs, and such concrete, once hardened, prevents removal of the wall from the assembly jig.

Moreover, even slight irregularities in the sidewalls of the channel members also tend to lock the wall into the assembly jig. For instance, if a dent exists in the sidewall of a channel member, that dent will, depending upon the direction in which it protrudes, either be filled with or surrounded by hardened concrete. Under such circumstances, it is impossible to pull out the concrete beam formed within the channel member without chipping, or at least scoring, the concrete beam. Furthermore, even if the damage to the prefabricated concrete wall can be tolerated, the rigid channel members of the assembly jig of the prior art require much more force, more powerful equipment, and more disassembly time than is desirable to remove the finished wall from the assembly jig.

SUMMARY OF THE INVENTION

The present invention eliminates the problems of the prior art assembly jig associated with removal of a completed prefabricated concrete wall from the assembly jig. Use of the present invention eliminates the requirement of excessive force to break the wall loose from the jig, prevents damage to the finished wall, and speeds up the manufacturing process. This is accomplished by the use of channel members which have hinged sides, so that once the concrete has hardened, the channel members themselves are opened up to furnish clearance between the assembly jig and the upper beam, the lower beam, and the studs of the finished wall. Thus, no breakaway force need be applied between the assembly jig and the finished wall, and the lifting equipment is only required to handle the actual weight of the wall.

The channel members hinged sidewalls also facilitate assembly of auxiliary devices, such as end configuration molds, onto the assembly jig. End configurations for the prefabricated wall sections vary with the application planned for a wall section. Regardless of the wall section end configuration, connectors within boxes cast into the upper and lower concrete beams are used to clamp adjacent sections together.

For instance, when two wall sections are to be joined to form a longer wall, each section is constructed with a stud at only one end, but with the surface concrete sheath terminating with an edge perpendicular to the wall surface. Thus, when the stud end of another similar section is butted up to the end of a section without a stud, the resulting wall joint matches, but does not result in two abutting studs. However, for a corner configuration, the wall section end configuration must include an angled surface. Thus, for a typical right angle corner, the wall section end surfaces are cast at 45 degrees to the concrete outer surface.

During manufacture each of these different end structures requires a different end frame member, but with hinged sidewalls on the channel members, different end frame member shapes may easily be attached to standard channel members and individual assembly jigs are not required for each end configuration.

The basic structure of the assembly jig of the present invention is two parallel continuous longitudinal members with "L" cross sections which are attached to parallel base beams that are themselves attached to fixed cross beams. The "L" members are attached to the outer edges of the top surfaces of the base beams with hinges and are oriented so that the base of each "L" is closer to the other parallel "L" member than the vertical side. The vertical sides of the "L"s are therefore the outermost walls of the eventual channel member and determine the perimeter of the assembly jig. Because of the hinged connection, each "L" mamber can be pivoted down from its position with the outer wall in a vertical orientation, the position used when the jig is receiving concrete, to a non-vertical orientation, which is used to release the finished wall or to set up the assembly jig.

The inner edges of the base beams, also have hinges to which inner vertical sections are attached. However, when installed these inner vertical sections do not form a continuous wall, but are spaced from each other by dimensions appropriate to accommodate the width of the preformed concrete studs which will fit between them. These inner vertical sections of the assembly jig also have flexible gaskets along their vertical edges which abut the installed preformed concrete beams. These flexible edge gaskets seal the vertical sections against the preformed concrete beams, and therefore prevent the concrete from leaking through the junction, hardening, and gradually building up until the concrete would, as in the prior art, interfere with the insertion of subsequent preformed concrete beams into the assembly jig.

It should be appreciated that the heights of the inner vertical sections are not as great as the height of the outer vertical sidewall of the assembly jig. The difference in height is necessary because it is that dimension which is filled with sheet insulation, wire reinforcing mesh, if used, and concrete to form the outer sheath of the prefabricated wall.

With several inner vertical sections in place, the preformed concrete studs installed, the outer vertical walls in their vertical positions, and suitable end frame members closing off the ends of the assembly jig of the present invention, the procedure for installing insulation and pouring concrete into the assembly jig is exactly the same as when rigid channel members are used for forming the top and bottom beams of the wall. However, significant differences show up in the removal of the finished wall from the assembly jig.

All that is required to remove a finished wall from the assembly jig of the present invention is to move two levers to release the holding catches on each outer vertical side of the assembly jig. The "L" members then separate from the finished wall and pivot down and away from the finished wall because of their own weights. This makes the cast holes for lifting fixtures accessible, and after attachment of the lifting fixtures, the finished wall is lifted out of the assembly jig. If, for any reason, an inner vertical section sticks to the finished wall, it simply pivots off its rest position until it breaks loose from the finished wall, and then it falls back into position on the assembly jig. There is never any difficulty in removing the finished wall from the assembly jig, because the assembly jig itself is essentially disassembled before the finished wall is removed.

Construction of the next wall is then begun by placing new preformed studs in place across the bases of the "L" members between the inner vertical sections, lifting the outer "L" members into their locked vertical positions, and laying in the sheet insulation.

The present invention thereby significantly speeds the construction of the prefabricated walls, and eliminates the major problem of finished walls locking into the assembly jig and causing damage to the walls.

DETAILED DESCRIPTION OF THE INVENTION

Figure 1:
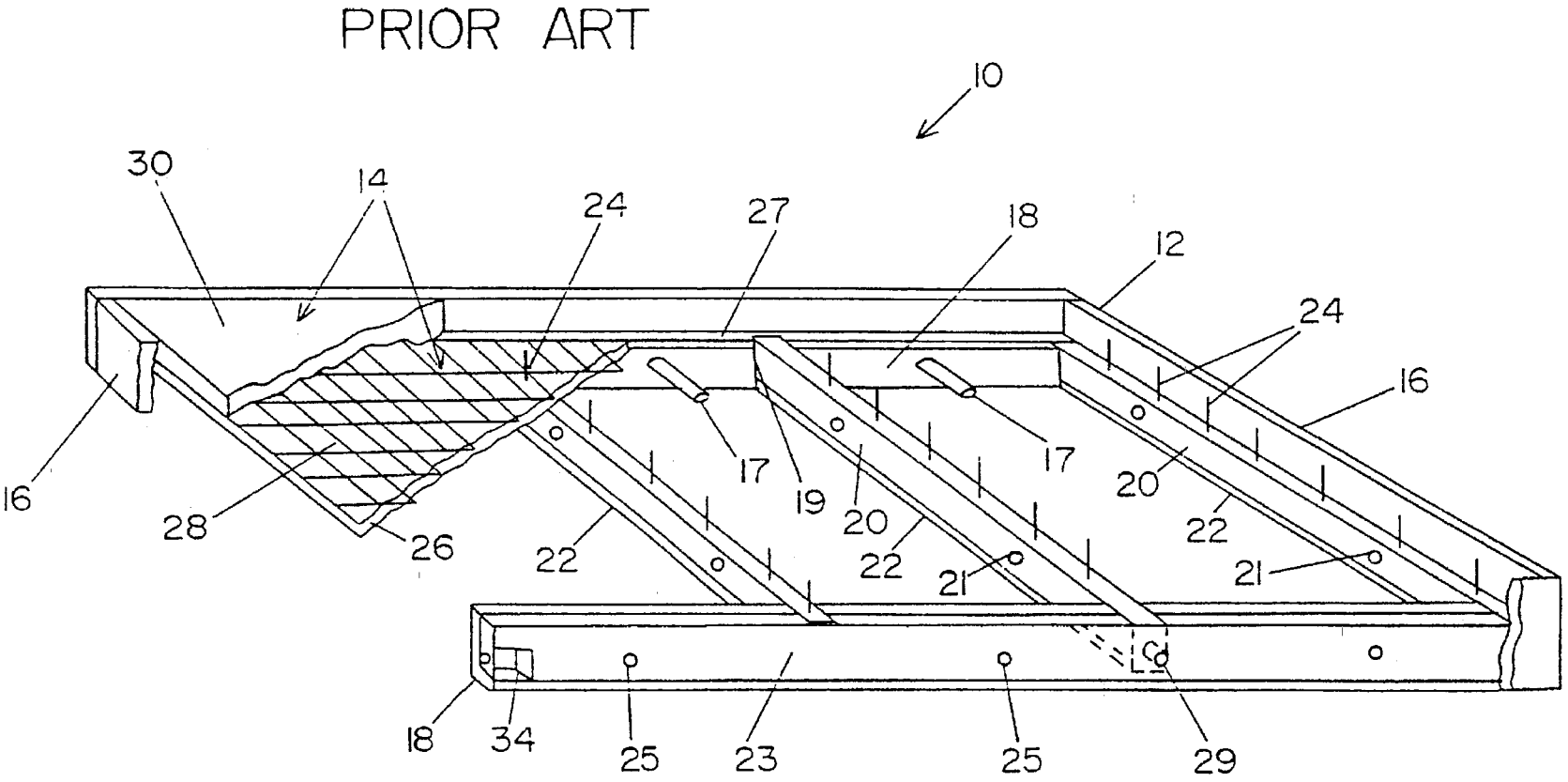
PRIOR ART FIG. 1
FIG. 1 is a cut-away perspective view of the prior art disclosure of a prefabricated wall assembly jig.

FIG. 1 is a perspective view of the prior art type of prefabricated wall assembly jig which is constructed of rigid members, but which is shown here because it is advantageous for describing the context in which the present invention is used. FIG. 1 is a cut-away view, of an assembly 10 containing both prior art assembly jig 12 and prefabricated wall section 14 as they appear just after the completion of construction. Both assembly jig 12 and wall section 14 are shown cut away so that the apparatus of the invention can be more easily seen.

Assembly jig 12 is formed essentially from framing member 16, which surrounds the periphery of the wall section, and support members 18 which locate and support concrete studs 20 that are the skeleton of wall section 14. Support members 18 and framing member 16 determine the basic shape of a rigid channel or "U" which forms a cavity that is approximately the same depth as the height of concrete studs 20. Support members 18 are supported in a horizontal plane by a planar surface or the earth itself (not shown), and are interrelated to each other by attaching the bottoms of the individual support members 18 to individual cross beams (not shown) so that the cross beams and support members 18 together form a total self supporting rigid skeletal assembly even before studs 20 are added.

Support members 18 are oriented so that they are parallel to each other, and they determine a configuration similar to the top and bottom beams of conventional walls. They also have notches 19 in their inside walls so that concrete studs 20 can be set into notches 19 to form a planar support skeleton with occasional cross studs extending between the two parallel channels. Assembly jig 12 thus performs the task of locating the several preformed concrete studs 20 into the proper configuration to furnish the skeletal frame upon which wall section 14 is assembled.

Studs 20 are long concrete members of essentially rectangular cross section which contain wood strips on one edge and protruding fasteners 24 on the other edge, both of which are attached to stud 20 as it is being manufactured. Studs 20 also include several holes 21 through their thickness at various locations along their length. These holes serve to permit electrical cables and plumbing pipes to pass through the them after the wall section is installed as part of a building.

To construct wall section 14, concrete studs 20 are placed within notches 19 of support members 18 to form a typical rectangular grid configuration with several studs 20 oriented perpendicular to support members 18 within which concrete will be poured. Studs 20 are placed within support members 18 so that wood strips 22 are downward and essentially inaccessible, while protruding fasteners 24 of all the studs point upward and the ends of studs 20 protrude into support members 18. Concrete studs 20 also contain reinforcing rods 29 which are arranged to protrude from the ends of concrete studs 20 and into the cavities of support members 18. When all the studs are in place, only one is adjacent to parallel frame member 16, and the studs of the skeletal framework extend fully between support members 18.

Construction of wall section 14 continues with the production of three successive layers of material onto the stud framework from which multiple fasteners 24 protrude. Insulation sheet 26 is first laid across the framework except for the tops of support members 18 to form a complete surface, but is shown for clarity in FIG. 1 as only a small section. Insulation sheet 26 is impaled upon fasteners 24, and after it is installed fasteners 24 protrude through it.

A layer of wire mesh 28 can be installed for reinforcement of the subsequent concrete layer if desired. Wire mesh 28 is laid atop the entire surface formed by insulation sheet 26, but after installation of wire mesh 28 fasteners 24 still protrude through the plane of wire mesh 28 so that substantial lengths of fasteners 24 are exposed.

Before pouring concrete into assembly jig 12, box structures 34 are placed adjacent to the ends of the cavities of support members 18 and are therefore encased within the concrete when it hardens. Box structures 34 enable adjacent finished wall sections to be attached to form longer sections, by passing clamping bolts through the holes in abutting box sections 34 and using box sections 34 for access to tighten nuts onto the clamping bolts.

The final layer added is concrete 30. Conventional wet concrete is poured into the tray-like container formed by framing members 16 on the edges and insulation sheet 26 as a bottom surface, with wire mesh 28 already in the "tray". Concrete is also poured into and fills the cavities in support members 18, thus forming two new concrete beams 23 and 27, and encasing the ends of concrete studs 20 so that they interlock with new concrete beams 23 and 27.

When concrete 30 hardens it not only covers wire mesh 28 and insulation sheet 26, but it also encapsulates fasteners 24 and the ends and reinforcing rods 29 of concrete studs 20, thereby forming a unitized structure which bonds together the entire wall structure. The encapsulation of the ends of concrete studs 20 and fasteners 24, which were previously cast into the concrete of each concrete stud 20, holds each concrete stud 20 firmly attached to unitized wall section 14.

The prior art describes the final step of manufacture of the wall as lifting hardened concrete wall 14 from assembly jig 12 by jacking one edge of wall 14 out of assembly jig 12, and then attaching lifting aids, such as eyebolts, through holes 25 formed in concrete beams 23 and 27 by the use of cores 17.

However, the task of removing finished wall 14 from assembly jig 12 of the prior art is much more difficult than one might suppose. There is a significant tendency for wall 14 to adhere to assembly jig 12 and lock up within it. For example, concrete may leak through the edges of notches 19 cut in support members 18, and such concrete, once hardened, makes removal of wall 14 from assembly jig 12 more difficult.

Moreover, even slight irregularities in the sidewalls of support members 18 also tend to lock wall 14 into assembly jig 12. For instance, if a dent exists in the sidewall of a support member 18, that dent will, depending upon the direction in which it protrudes, either be filled with or surrounded by hardened concrete. Under such circumstances, it is impossible to pull out concrete beam 23 or 27 formed within the support member 18 without chipping, or at least scoring, the concrete beam. Furthermore, even if the damage to the prefabricated concrete wall would be tolerable, rigid support members 18 of assembly jig 12 of the prior art require much more force, more powerful equipment, and more disassembly time than is desirable to remove the finished wall from the assembly jig.

Figure 2:
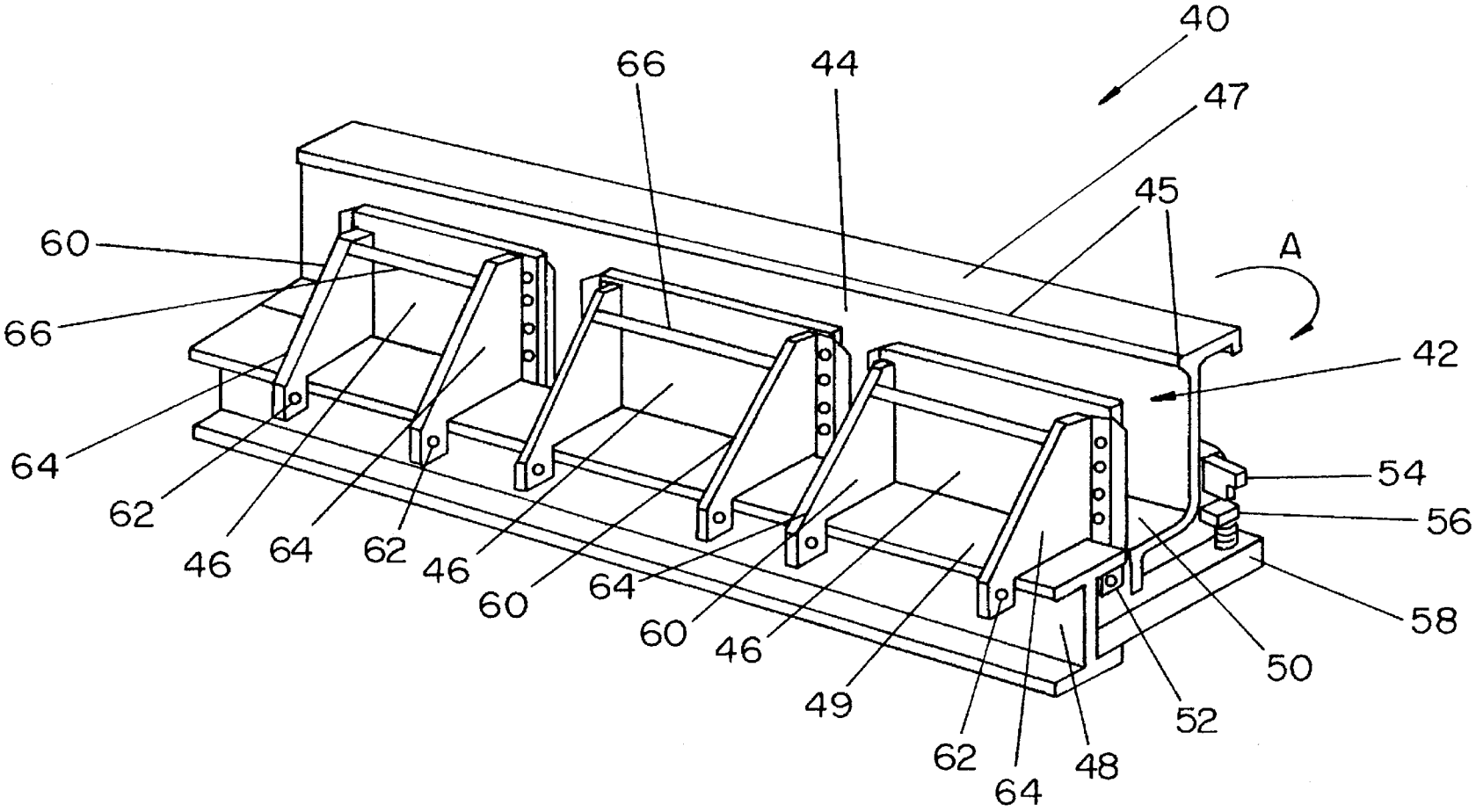
FIG. 2 is a perspective assembly view of the preferred embodiment of the improved combined frame and support member of the invention.

FIG. 2 is a perspective assembly view of the preferred embodiment of a section of the combined frame and support member for an improved assembly jig for constructing prefabricated concrete walls. Combined frame and support member 40 is used instead of the prior art frame and support member with fixed vertical walls, and permits the finished wall to easily be removed from the assembly jig. Removal of the wall is facilitated because, although frame and support member 40 includes cavity 42 which will be filled with concrete to form the upper or lower beam of the finished wall, outer vertical wall 44 and inner vertical wall 46 of cavity 42 are both pivotably attached to base 48. These pivoting connections permit frame and support member 40 to be separated from the hardened concrete of a finished wall, and the wall to be lifted from the assembly jig without difficulty.

Outer vertical wall 44 is integrated with bottom 50 of cavity 42 to form an "L" shaped cross section with base leg 50 and outer leg 44, so that both the outer and bottom surfaces of cavity 42 are released from a concrete beam which has hardened when vertical wall 44 and bottom 50 pivot down in the direction indicated by arrow A. Outer vertical wall 44 pivots around pivot point 52 which is only one of several such points attached along the lengths of base 48 and elongated outer vertical wall 44.

Outer vertical wall 44 has top bead 45 which forms a desirable feature in the finished wall section. Without bead 45 it is possible for the finished concrete wall surface to overlap and cover small portions of top flange 47 of outer vertical surface 44. When such concrete hardens it forms a sharp edge protruding from the corner of the surface of the finished concrete wall surface which is formed within cavity 42, and such protrusions interfere with the integration of the finished wall section into a building. To prevent such protruding concrete edges, top bead 45 actually extends slightly across the top of cavity 42, and thereby forms a chamfer on the edge of the concrete wall. The chamfer prevents any excess concrete from accumulating at the corner of the beam.

Outer vertical wall 44 is held in its vertical position by latch 54 which is attached to the outer surface of outer vertical wall 44 and rests upon stop bolt 56. Stop bolt 56 is inserted into a matching thread within support fixture 58 which is rigidly attached to base 48. The structure and operation of latch 54 is more fully described in the following discussion of FIG. 4.

While outer vertical wall 44 of cavity 42 is continuous for the entire length of any particular assembly jig, inner vertical wall 46, which is parallel to outer vertical wall 44 when assembly jig 40 is fully assembled, is constructed as several individual, standard length, inner assemblies 60. The length of each inner assembly 60 determines the selected spacing between concrete studs which will be inserted between the several inner assemblies 60 during construction of the wall. Since the preferred center to center spacing for the concrete studs in 24 inches, the total length of each inner assembly 60 is 24 inches less the thickness of the concrete studs to be used.

Each inner assembly 60 is pivotably attached to base 48 at pivot points 62 and rests upon top surface 49 of base 48. Although the position of inner assembly 60 on top surface 49 of base 48 prevents releasing inner wall 46 from a finished concrete wall before the wall is lifted from the assembly jig, the pivoting action of inner assembly 60 causes the wall to separate from inner wall 46 without application of any significant force. This easy release is the result of the small radius of the pivoting movement of inner assembly 60 and the typical manner in which a finished wall is removed from the assembly jig.

Once outer vertical walls 44 are released and tilted downward, a lifting device is typically attached to one of the wall beams, either the top or bottom wall beam, of the finished wall which is resting within cavity 42. As described in regard to the prior art assembly jig shown in FIG. 1, the lifting device is attached to the wall beam by means of lifting devices attached to holes formed in the wall beam when it is cast. The typical lifting procedure is that only the one wall beam at either the top or the bottom of the wall is raised, while the beam at the other end of the finished wall is left resting on the assembly jig.

Since the outer vertical walls at both the top and bottom of the finished wall have been released, the beam which is still resting on the assembly jig simply pivots and peels away from inner vertical wall 46 as the other end of the wall is lifted. This turning of the beam resting on the assembly jig easily separates the beam from inner vertical wall 46, since the lifting force creates a torque with a lever arm of the height of the wall section which is typically a dimension of eight feet, and any bonding forces resisting separation create torque with a lever arm of only the width of the beam, which is typically four to six inches.

The separation of inner vertical wall 46 from the beam at the end of the finished wall which is being lifted out of the assembly jig also has the advantage of the height of the wall section as a turning radius, but the action is slightly different. When the lifting of the beam begins, if the inner vertical wall is bonded to the beam, inner vertical wall 46 simply moves along with the beam as inner assembly 60 pivots on pivot points 62. However, the lifted beam is pivoting on the eight foot radius of the height of the wall section, while the radius of the pivoting of inner assembly 60 is only the order of one foot. This difference in turning radius again causes inner vertical wall 46 to simply peel off of the beam being lifted without the need for any significant additional force, regardless of the bonding forces resisting the separation.

Figure 3:
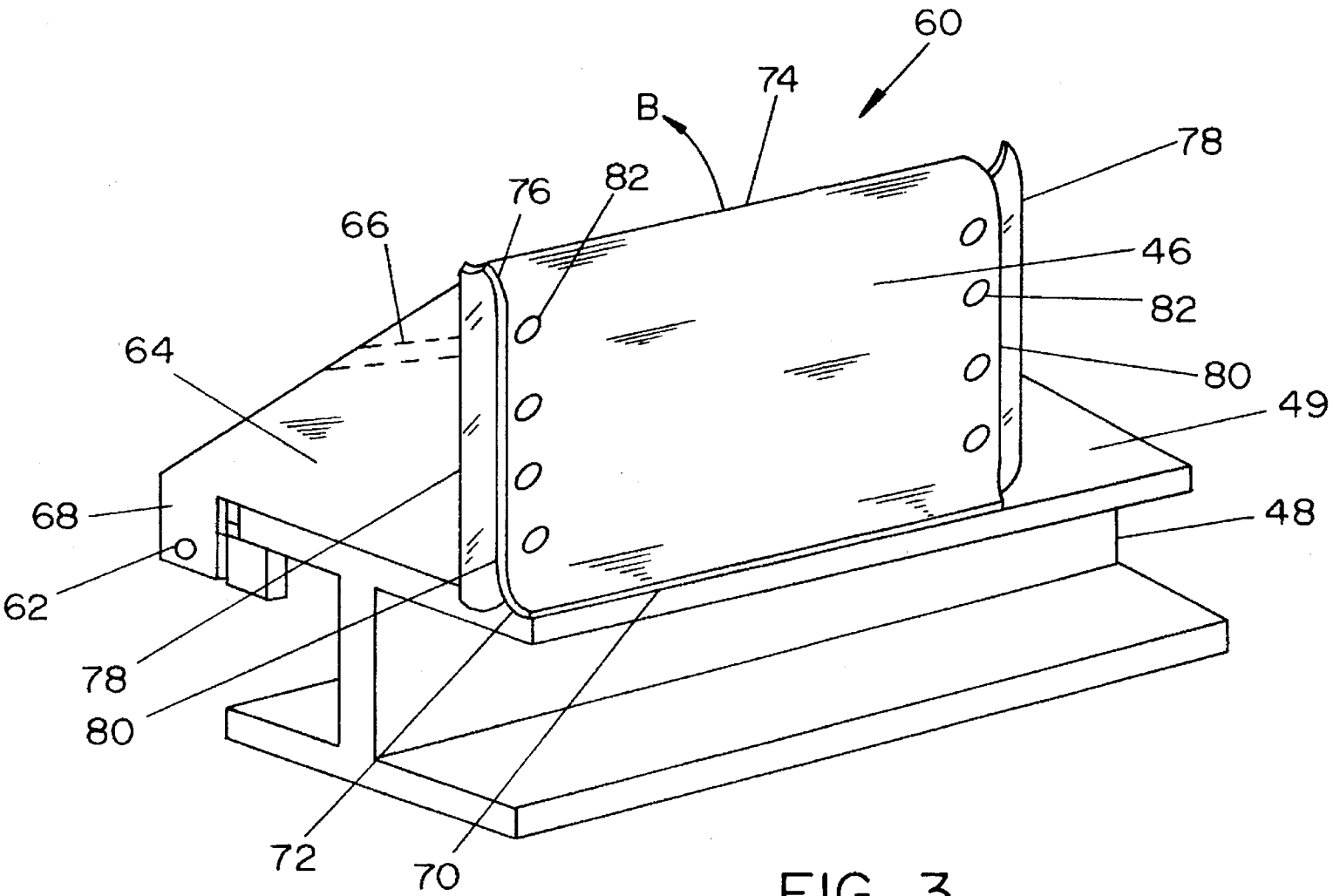
FIG. 3 is a perspective view of the inner assembly of the combined frame and support member of the preferred embodiment.

FIG. 3 is a perspective view of inner assembly 60 of the preferred embodiment of frame and support member 40. Inner assembly 60 is constructed of inner vertical wall 46 attached to and supported vertically by side supports 64. Side supports 64 are interconnected by brace 66 (FIG. 2) which makes inner assembly 60 rigid. Side supports 64 each have extension 68 located at the lower rear corner, and extensions 68 each include pivot point hole 62. When installed on frame and support member 40 as pictured in FIG. 2, inner assembly 60 rests on top surface 49 of base 48, and the direction of pivoting of inner assembly 60 is shown by arrow B.

All four edges of vertical inner wall 46 can be shaped to determine features of the finished concrete wall. Lower edge 70 is shaped with curve 72 which has a center of curvature within cavity 42 (FIG. 2), so that the inner edge of the cast beam of the finished wall has a chamfer cast into it, and no sharp corners are formed. Upper edge 74 is formed with a curve 76 with its center of curvature located between side supports 64, so that curve 76 forms a rounded inside corner between the cast beam and the sheet insulation laid, atop of edge 74.

Gaskets 78 are attached to vertical edges 80 of inner vertical surface 46, and gaskets 78 are also formed with curves so that they curve back toward side supports 64. Gaskets 78 extend into the spaces between the several inner assemblies 60 so that, when a preformed concrete stud is placed between two inner assemblies 60, gaskets 78 seal tightly against the inserted stud. This seal prevents the wet concrete used to form the cast beam in cavity 42 from leaking past gasket 78. Flush head bolts 82 clamp gaskets 78 between inner vertical surface 46 and a portion of side support 64 (seen in FIG. 2) which is bent so that it is parallel to inner vertical surface 46.

It has also been found to be beneficial to cut vertical edges 80 of inner vertical surface 46 so that they are not perpendicular to the plane of inner vertical surface 46, but form obtuse angles with the plane. Such angular edges prevent accumulation of concrete on edges 80 after several uses, and the finished cast walls continue to release easily and be formed in the shape of the original structure of cavity 42 (FIG. 2) without imperfections caused by accumulating concrete.

Figure 4:
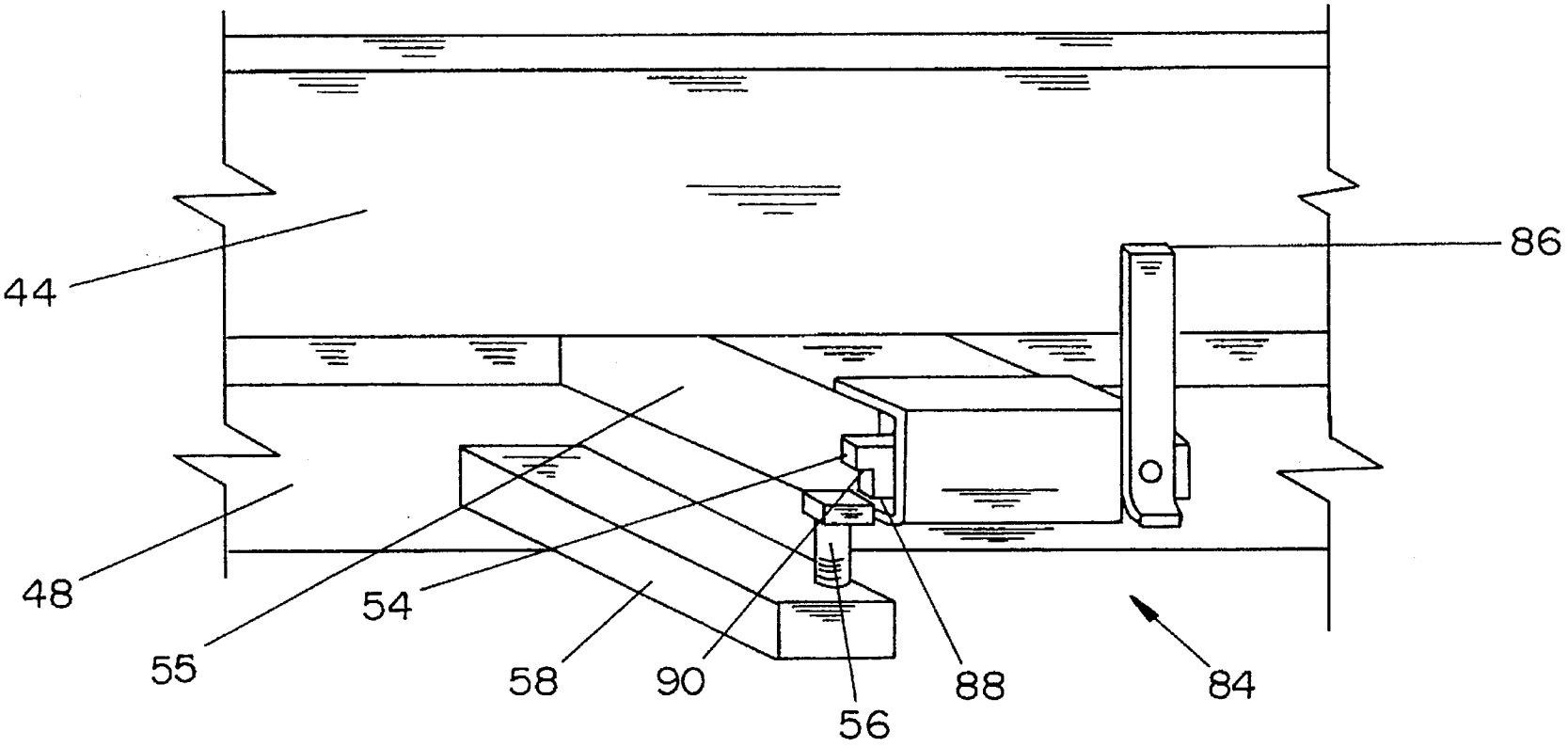
FIG. 4 is a perspective view of the latch assembly of the outer vertical wall of the combined frame and support member of the preferred embodiment of the invention.

FIG. 4 is a perspective view of latch assembly 84 of outer vertical wall 44 of frame and support member 40 of the preferred embodiment of the invention.

Outer vertical wall 44 is held in its vertical position by latch 54 which is attached to the outer surface of outer vertical wall 44 by support 55. Latch 54 rests upon stop bolt 56, and since stop bolt 56 is inserted into a matching thread within support fixture 58 which is rigidly attached to base 48, adjustment of the extension of stop bolt 56 above support fixture 58 can be used to adjust outer vertical wall into an exactly vertical position. Lever 86 is used to operate latch 54 to release outer vertical wall 44 so it can be pivoted down as described in regard to FIG. 2.

However, latch 54 actually permits two upright positions for outer vertical wall 44. One position, when bottom edge 88 of latch 54 is resting on stop bolt 56, locks outer wall 44 fully upright in a vertical position for pouring the concrete into the assembly jig to form the wall and integral beams. The second position of latch 54, when notch 90 of latch 54 is resting on stop bolt 56, positions outer vertical wall 44 slightly off of the full vertical position. This near vertical position is advantageous for setting up the assembly jig by assembling the several parts into it.

With outer vertical wall 44 in a near vertical position, inner assemblies 60 can easily be installed, and the previously manufactured concrete beams can also be installed between inner assemblies 60. Furthermore, end frame members, which, as described in regard to FIG. 5 below, can be built with retaining parts which are clamped between outer vertical walls 44, can more easily be installed when outer vertical wall 44 is near vertical. The near vertical position permits ease of alignment, but still allows for some limited movement. When outer vertical wall 44 is then latched into the full vertical position, the jig is ready for concrete.

Figure 5:
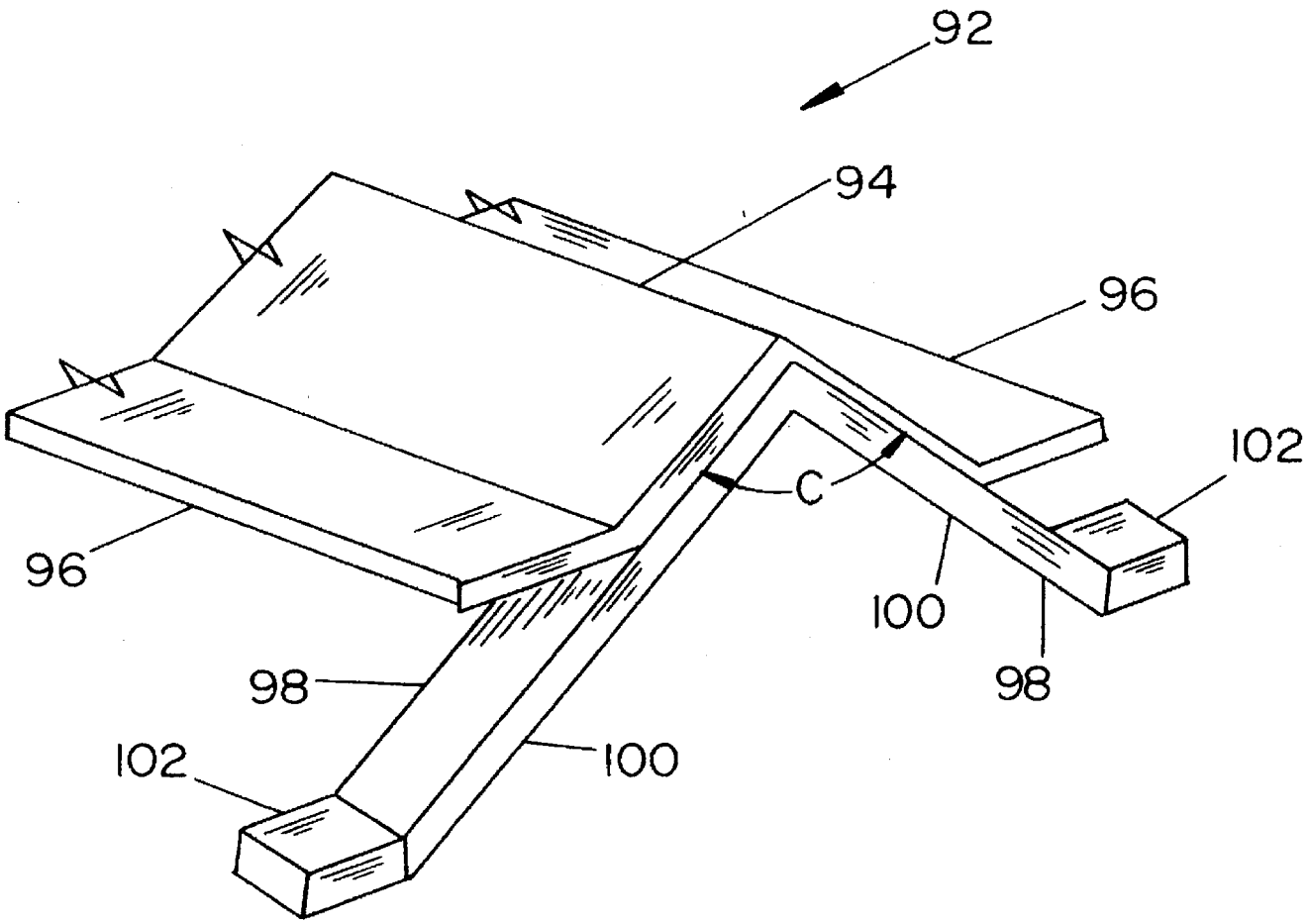
FIG. 5 is a perspective view of one end of the preferred embodiment of an end frame member used with the present invention.

FIG. 5 is a perspective view of one end of the preferred embodiment of an end frame member 92 used with the present invention. End frame member 92 forms an end of an assembly jig for a prefabricated wall, and has a body 94 which is essentially an elongated angle iron with two flanges 96 added onto the legs of the angular cross section. The angle of body 94 determines the end configuration of the concrete sheath of the finished wall, and the flanges 96 support the end of the sheet insulation laid into an assembly jig. Angle C shown on body 94 in FIG. 5 is 90 degrees and would therefore be appropriate for a panel which is one side of a right inside angle in a room because it forms the end of a wall which has an edge which is 45 degrees to the surface of the finished wall. Other angles can be used on end frame 92 for the production of walls which meet with junctions which are other than right angles.

At each end of body 94 are located two retainer fixtures 98 which are in the form of simple extension legs attached to body 94. Retainer fixture 98 has horizontal foot 102 attached to angular leg 100, and horizontal foot 102 is located so that it can be clamped to top surface 49 of base 48 (FIG. 2). Thus when retainer fixtures 98 on both ends of end fixture 92 are clamped in place, and the outer vertical walls are raised to the full vertical position, the tray to hold concrete is complete. An end closure (not shown) can also be added to cavity 42 to complete the structure of the assembly jig so that it will form the complete tray show in FIG. 1.

The improved frame and support member of the invention thus furnishes an assembly jig for prefabricated concrete walls which is both easy to assemble and can itself be disassembled, so that the finished concrete wall is released from the assembly jig with out special effort.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters patent of the United States are desired to be secured is:

1. An assembly jig for prefabricated concrete wall sections comprising:

a base structure;

two elongated "L" members, each with a bottom wall at the lower end of an outer wall of a first height connected to form a right angle cross section similar to an "L", with each outer wall interconnected with the base structure by first pivot means and having a stable position in which the outer wall is stationary and is located in a vertical plane,and the bottom wall is stationary and located in a horizontal plane, and with the "L" members being located so that they are spaced from each other, are parallel to each other, and the bottom walls are closer to each other than are the outer walls;

latch means interconnected with each outer wall to hold the outer wall in the stable position and to release the outer wall from the stable position to permit the outer wall to move out of a vertical plane; and at least two inner walls of a second height, with each inner wall interconnected with the base structure by second pivot means and having a stable position in which the inner wall is stationary and is located in a vertical plane, along and adjacent to the bottom wall, and parallel to the outer wall of an "L" member, and with the inner walls having vertical end edges, and the inner walls being located so that they are spaced apart by a dimension equal to the width of a stud which will be placed between the inner walls and adjacent to the vertical end edges, and with the second height of the inner wall being less than the first height of the outer wall.

2. The assembly jig of claim 1 wherein the latch means has two settings, one setting which locates the outer wall in a vertical position and a second setting which locates the outer wall in a position other than vertical.

3. The assembly jig of claim 1 wherein the outer wall and the bottom wall are rigidly connected and the first pivot means is attached to the bottom wall, so that the outer wall and the bottom wall pivot together.

4. The assembly jig of claim 1 wherein the inner wall is supported by side supports which extend away from the inner wall on the side of the inner wall remote from the outer wall, and the second pivot means is attached to the side supports at a location remote from the inner wall.

5. The assembly jig of claim 1 wherein the vertical end edges of the inner wall comprise flexible gaskets which can seal against studs located adjacent to the vertical end edges.

6. The assembly jig of claim 1 further including an end frame member which is clamped between two pivoting "L" members and includes a body which is shaped to determine the end configuration of a concrete sheath of a prefabricated concrete wall formed within the assembly jig.

7. The assembly jig of claim 1 wherein the outer wall includes a bead on its upper edge, with the bead extending from the outer wall toward the inner wall.

* * * * *